US005659285A

United States Patent [19]

Takeda

[11] Patent Number: 5,659,285

[45] Date of Patent: Aug. 19, 1997

[54] DOUBLE SAFETY THERMOSTAT HAVING MOVABLE CONTACTS DISPOSED IN BOTH ENDS OF A RESILIENT PLATE

[75] Inventor: Hideaki Takeda, Misato, Japan

[73] Assignee: Uchiya Thermostat Co., Misato, Japan

[21] Appl. No.: 474,317

[22] Filed: Jun. 7, 1995

[30] Foreign Application Priority Data

Jun. 10, 1994 [JP] Japan ..... 6-128625

[51] Int. Cl.[6] ..... H01H 37/46

[52] U.S. Cl. ..... 337/389; 337/333; 337/337; 337/380

[58] Field of Search ..... 337/298, 333, 337/337, 340, 371, 380, 354, 140, 408

[56] References Cited

U.S. PATENT DOCUMENTS

| | | | |
|---|---|---|---|
| 4,092,624 | 5/1978 | Tomoyoshi et al. . | |
| 4,470,033 | 9/1984 | Hofsass | 337/343 |
| 4,568,904 | 2/1986 | Takahashi et al. . | |
| 4,808,965 | 2/1989 | Cenky . | |

FOREIGN PATENT DOCUMENTS

| | | | |
|---|---|---|---|
| 0058372A1 | 8/1982 | European Pat. Off. . | |
| 2508807A1 | 2/1975 | Germany | H01H 37/54 |
| 2821457A1 | 11/1979 | Germany | H01H 37/54 |
| 2640181C2 | 3/1985 | Germany | H01H 37/54 |
| 3644514C2 | 12/1988 | Germany | H01H 37/74 |

*Primary Examiner*—Leo P. Picard
*Assistant Examiner*—Jayprakash N. Gandhi
*Attorney, Agent, or Firm*—Fish & Richardson P.C.

[57] ABSTRACT

An object of the present invention is to provide a thermostat including a protection circuit for protecting a circuit even if contacts of the thermostat are welded. Movable contacts are disposed in both ends of a resilient plate deformed by a thermally responsive member and stationary contacts are disposed to correspond to both the movable contacts. External terminals are disposed to correspond to the stationary contacts. The strength of the spring on the side of one movable contact of the resilient member is made weaker than the strength of the spring on the side of the other movable contact. Normally, the movable contact having the weaker strength of the spring is opened and closed in response to the deformation of the thermally responsive member and if this contact are welded, the other movable contact is opened and closed. In the preferred embodiment, the second thermally responsive member for operating one movable contact is provided.

17 Claims, 6 Drawing Sheets

DOUBLE SAFETY THERMOSTAT HAVING MOVABLE CONTACTS DISPOSED IN BOTH ENDS OF A RESILIENT PLATE

FIELD OF THE INVENTION AND RELATED ARTS

The present invention relates to a double safety thermostat.

There is known a thermostat including two terminals connected to an external circuit, a stationary plate connected to one of the two terminals and having a stationary contact, a resilient plate connected to the other terminal and having a movable contact, and a thermally responsive element constituted by, for example, a bimetal which is deformed by temperature temporarily and deforms the resilient plate by the deformation of the bimetal to open and close between the stationary contact and the movable contact.

Such a thermostat using the thermally responsive element interrupts a circuit in response to rising or falling of temperature and accordingly the thermostat can be used for adjustment of temperature.

However, since the thermostat includes mechanical contacts, there is a possibility that the contacts are welded to each other.

In order to secure the safety of the circuit in such a case, a temperature fuse is disposed in series to the thermostat.

When a series connection of the thermostat and the temperature fuse is provided in an electric apparatus, the number of components in the electric apparatus is increased and a manufacturing cost thereof is also increased.

Further, it is sometimes difficult to assemble such elements into a small electric apparatus such as a hair drier, since free space in the apparatus is small.

OBJECTS AND SUMMARY OF THE INVENTION

It is an object of the present invention to provide a double safety thermostat including a protection circuit for protecting a circuit even if contacts of a thermostat are welded to each other.

It is another object of the present invention to provide a thermostat including clamping means for maintaining the contacts to be separated from each other when the contacts are separated from each other.

In order to solve the above problems, the double safety thermostat according to the present invention comprises a first stationary plate having a first terminal disposed in one end and connected to an external circuit and a first stationary contact disposed in the other end, a second stationary plate having a second terminal disposed in one end and connected to the external circuit and a second station contact disposed in the other end, a resilient plate having a first movable contact disposed in one end and a second movable contact disposed in the other end, a center support member for supporting the resilient plate at the center portion of the resilient plate, a thermally responsive member having the curvature of a shape thereof varying when a first predetermined set temperature is exceeded, and a plurality of claws for engaging the thermally responsive member with the resilient plate, and the first stationary plate, the resilient plate and the second stationary plate are electrically disposed in series to one another, the strength of a spring on the side of the first movable contact of the resilient plate being weaker than the strength of a spring on the side of the second movable contact, the first stationary and movable contacts and the second stationary and movable contacts being in contact with each other, respectively, in a lower temperature than the first set temperature, the first movable contact being separated from the first stationary contact when the first set temperature is exceeded, the movable contact being separated from the second stationary contact when the first movable contact is welded to the first stationary contact and the first set temperature is exceeded.

Preferred aspects of the present invention are described in the Claim 2 and subsequent Claims.

When the first set temperature is exceeded, the radius of the curvature of the thermally responsive member is varied and the resilient plate is deformed, so that the first movable contact is separated from the first stationary contact. When the temperature falls, the contacts are closed again.

When the first stationary contact and the first movable contact are welded to each other and the temperature rises, the second movable contact is separated from the second stationary contact.

The resilience of a portion on the side of the first contact of the resilient plate is weakened so as to open and close the first movable contact in the normal state. This can be attained by forming elongated holes in this portion or narrowing a width of this portion.

It is preferable to provide clamping means for clamping the second stationary contact and the second movable contact once both of the contacts are separated.

The clamping means can use a clamp spring which is sized to penetrate the resilient plate while pressing the resilient plate in the longitudinal direction of the resilient plate when the second stationary contact and the second movable contact are closed and not to penetrate the resilient plate when both of the contacts are separated from each other.

When the second movable contact is separated from the second stationary contact, the clamp spring does not penetrate the resilient plate and the tip of the clamp spring is moved in the longitudinal direction of the movable plate. Consequently, even when the temperature falls, the movable plate is impeded by the clamp spring and cannot be returned to its original shape, so that the second stationary contact and the second movable contact are maintained to be left open.

The clamping means can use a resistance heating element connected in parallel to the second stationary contact and the second movable contact.

When the first movable contact and the second movable contact are closed, almost no current flows through the resistance heating element. However, when the second movable contact is opened, a current flows through the resistance heating element and the bimetal plate is heated. Consequently, the opened state of the contact is maintained until the power supply of the electric appliance is cut off.

The clamp means can use a fuse spring having a spring embedded into an easily meltable metal in the contracted state of the spring and disposed in the vicinity of the second stationary plate of the second movable contact.

When the first stationary contact and the first movable contact are welded to each other and the temperature exceeds the melting point of the easily meltable metal, the easily meltable metal is melted and the spring extends to deform the resilient plate so that the second stationary contact and the second movable contact are fixed to be opened. Since the spring does not contract even when the temperature is reduced to the melting point or less, both the contacts are maintained to be left open.

The temperature at which the second stationary contact and the second movable contact are opened is defined by the strength of the springs of the thermally responsive member and the resilient plate and accordingly it is difficult to define it to an exact value. The second thermally responsive member can be disposed on the side of the first or second stationary plate of the resilient plate so that the second stationary contact and the second movable contact are opened when the thermally responsive member changes the curvature of the shape thereof to thereby settle the temperature.

In this case, when only one thermally responsive member is used, the same clamping means can be provided.

The thermally responsive member and the second thermally responsive member can use the bimetal plate having the curvature of the shape varying when the predetermined temperature is exceeded.

The thermally responsive member and the second thermally responsive member can use a member using a shape memory alloy and having the curvature of the shape varying when the predetermined temperature is exceeded.

Effects of the Invention

1) Even if an accident that the contacts of the thermostat are welded occurs, the circuit can be controlled exactly.
2) The degree of freedom for the design is large.
3) The number of components can be reduced. Accordingly, the occupation volume is small.
4) The cost of manufacturing an electric product can be reduced.

DETAILED DESCRIPTION OF THE PREFERRED EMBODIMENTS

FIGS. 1 to 7 show a preferred embodiment of the present invention.

Figure 7:
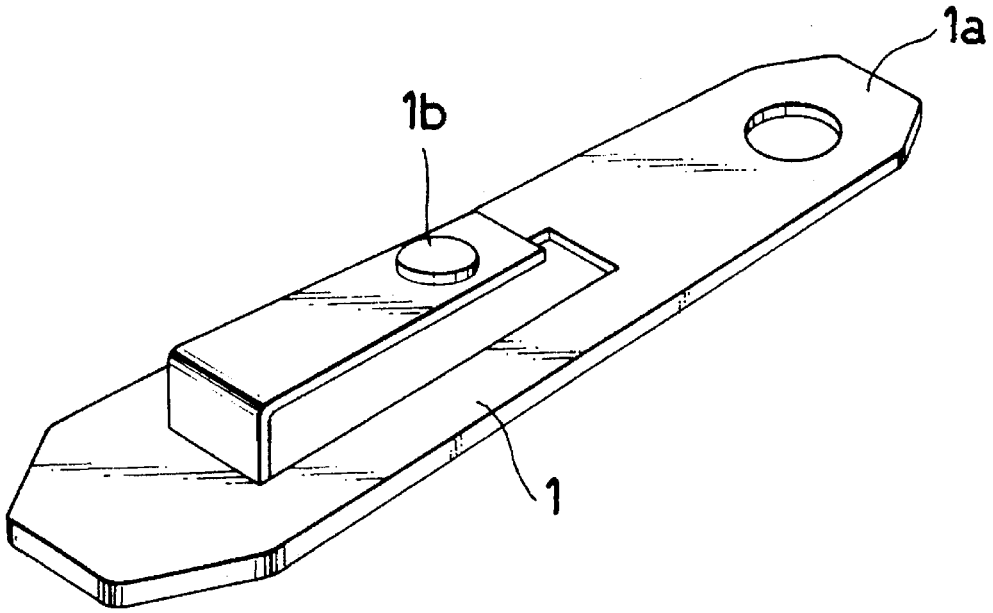
FIG. 7 is a perspective view of a stationary plate 1.

As shown in FIG. 7, a first terminal la connected to an external circuit is disposed in one end of a first stationary plate 1 and a first stationary contact 1*b* is disposed in the other end thereof. Similarly, a second terminal 2*a* connected to the external circuit is disposed in one end of a second stationary plate 2 and a second stationary contact 2*b* is disposed in the other end thereof.

The first and second stationary plates 1 and 2 are electrically insulated from each other and are embedded in a base or board 3 made of synthetic resins to be fixed together.

A resilient plate 4 is disposed above the first and second stationary plates 1 and 2 and is supported at a center portion thereof by means of a center support member 5. The center support member 5 is also embedded in the board 3 to be fixed thereto.

First and second movable contacts 6 and 7 are disposed in both ends of the resilient plate 4 so that the first and second movable contacts 6 and 7 are disposed in positions corresponding to the first and second stationary contacts 1*b* and 2*b*, respectively.

A thermally responsive element formed of a bimetal plate 8 is disposed above the resilient plate 4. The bimetal plate 8 is engaged with claws 4*a* formed by cutting the resilient plate into a C-shape and bending it. Accordingly, when a sign of the curvature of the shape of the bimetal 8 is reversed, the shape of the resilient plate 4 is varied correspondingly.

vertical guide members 13 are disposed at the sides of the bimetal 8 so as to prevent the bimetal 8 from being separated from the claws 4*a*. The vertical guide members 9 are part of a housing not shown.

Figure 5:
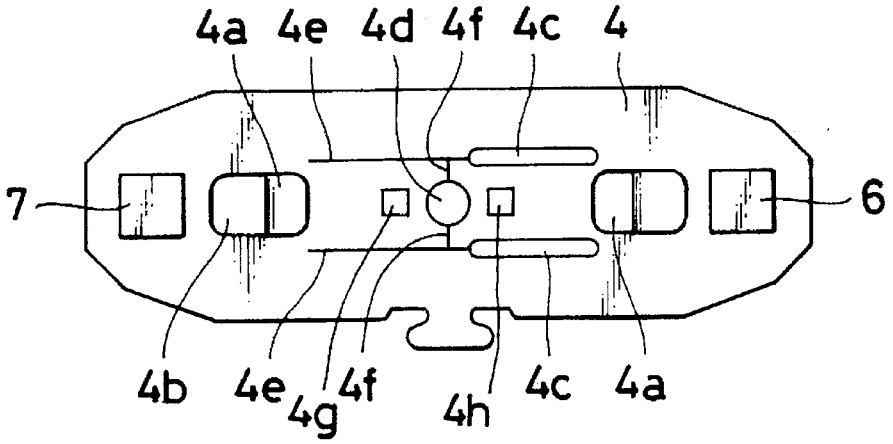
FIG. 5 is a top view of a resilient plate.

As shown in FIG. 5, through holes are formed in the portion in which the claws 4*a* of the resilient plate 4 are formed. Clamping means constituted by a clamp spring 9 penetrates the through hole 4*b* disposed near to the second movable contact 7.

The clamp spring 9 is fixedly mounted in the board 3 and always presses the resilient plate 4 in the longitudinal direction thereof.

The resilient plate 4 is formed so that the strength of the spring thereof on the side of the first movable contact 6 is smaller than that on the side of the second movable contact 7.

Figure 6:
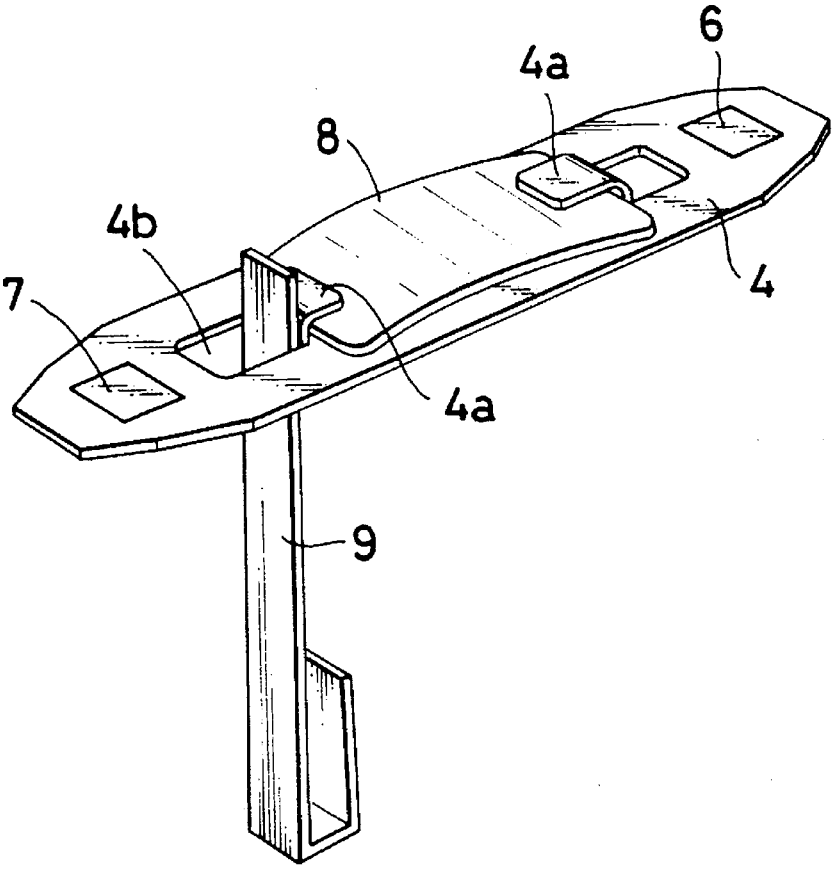
FIG. 6 is a perspective view showing a relation of the resilient plate and a clamp spring.

In the embodiment, a pair of elongated holes 4c are formed on the side of the first movable contact. 6 in the resilient plate 4. Consequently, the strength of the spring of the resilient plate 4 is reduced on the side of the elongated holes 4*c*. The resilient plate 4 is fixedly mounted to the center support member 5 in a center hole 4*d* and square holes 4*g* and 4*h*. When the curvature of the shape of the bimetal 8 is reversed, the resilient plate 4 is formed with cut portions 4*e* and 4*f* as shown in FIG. 6 so as to be able to follow deformation of the resilient plate easily. Adjustment of the strength of the spring of the resilient plate can be made by narrowing the width of the resilient plate 4 substantially or by adjusting the thickness of the resilient plate 4 or by providing ribs or rims in portions of the resilient plate except the above method.

When a temperature T is low, the first stationary contact 1*b* is in contact with the first movable contact 6 and the second stationary contact 2*b* is in contact with the second movable contact 7. Accordingly, a current flows through the first terminal 1*a*, the first stationary plate 1, the first stationary terminal 1*b*, the first movable contact 6, the resilient plate 4, the second movable contact 7, the second stationary contact 2*b*, the second stationary 2 and the second terminal 2*a* in the order of description or in the reverse direction thereof.

Figure 3:
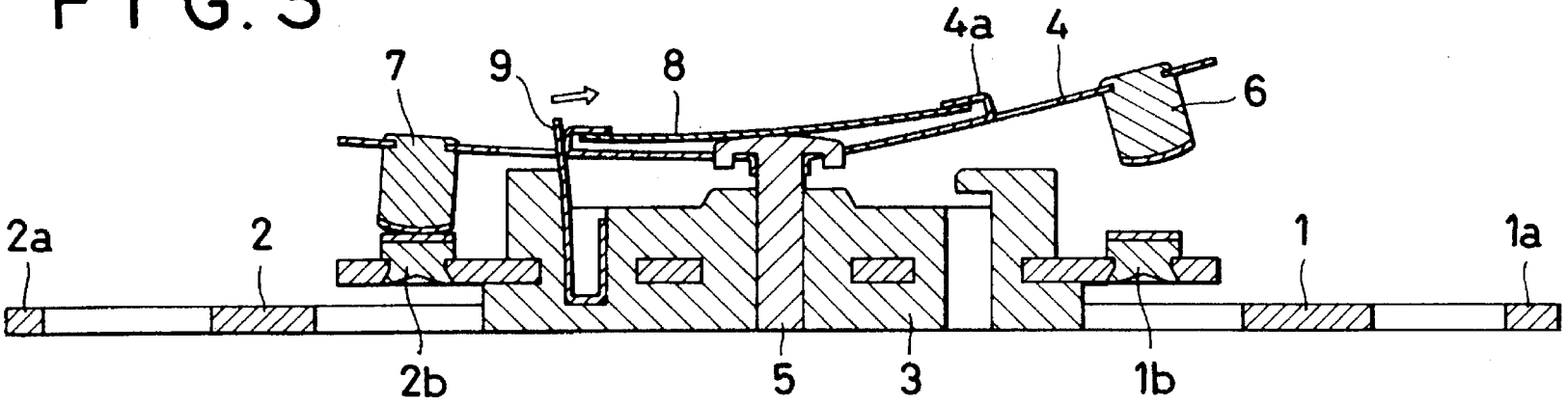
FIG. 3 is a sectional view for explaining operation of the embodiment of FIG. 1.

When the temperature T is higher than a first set temperature $T_1$, a sign of the curvature of the shape of the bimetal plate 8 is reversed. Since the strength of the spring of the resilient plate 4 is weak on the side of the first movable contact 6, the resilient plate 4 is deformed as shown in FIG. 3. Consequently, the first movable contact 6 is separated from the first stationary contact 1*b*, so that the circuit is opened.

When the temperature T is lower than the first set temperature $T_1$, the curvature of the shape of the bimetal plate 8 is reversed again and the resilient plate is deformed in response to the reversal of the curvature so that the first movable contact 6 comes into contact with the first stationary contact 1*b* to thereby close the circuit. This is reversible.

Figure 4:
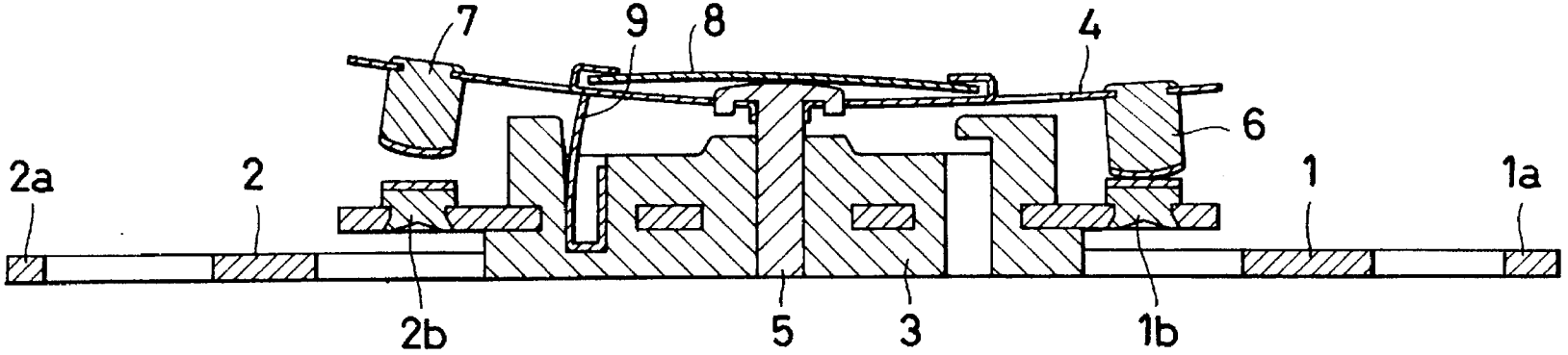
FIG. 4 is a sectional view for explaining operation of the embodiment of FIG. 1.

When the first stationary contact 1*b* is welded to the first movable contact 6 due to any cause, the second movable contact 7 is separated from the second stationary contact 2*b* at a high temperature as shown in FIG. 4.

In other words, the second stationary contact 2*b* and the second movable contact 7 function as a protection circuit.

When the temperature is reduced in the case where the clamping means, for example, such as the clamp spring 9 is not provided, the curvature of the shape of the bimetal plate 8 is reversed again and the resilient plate 4 is deformed in response to the reversal of the curvature so that the second movable contact 7 comes into contact with the second stationary contact 2*b* to thereby close the circuit. In other words, even after the second movable contact is welded to the first stationary contact, the thermostat of the embodiment can function as a thermostat reversibly.

Figure 1:
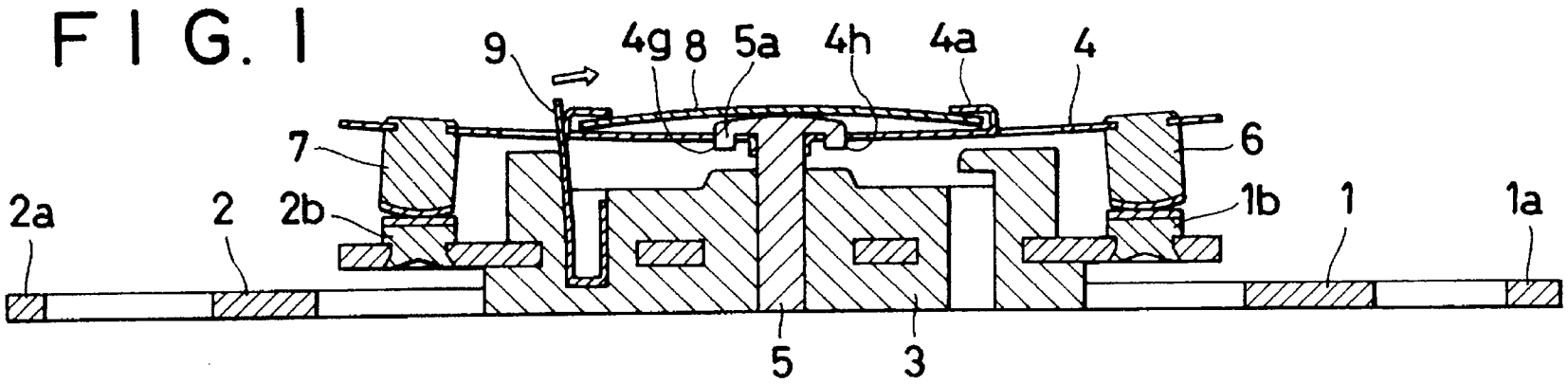
FIG. 1 is a sectional view showing a preferred embodiment of a double safety thermostat according to the present invention.
Figure 2:
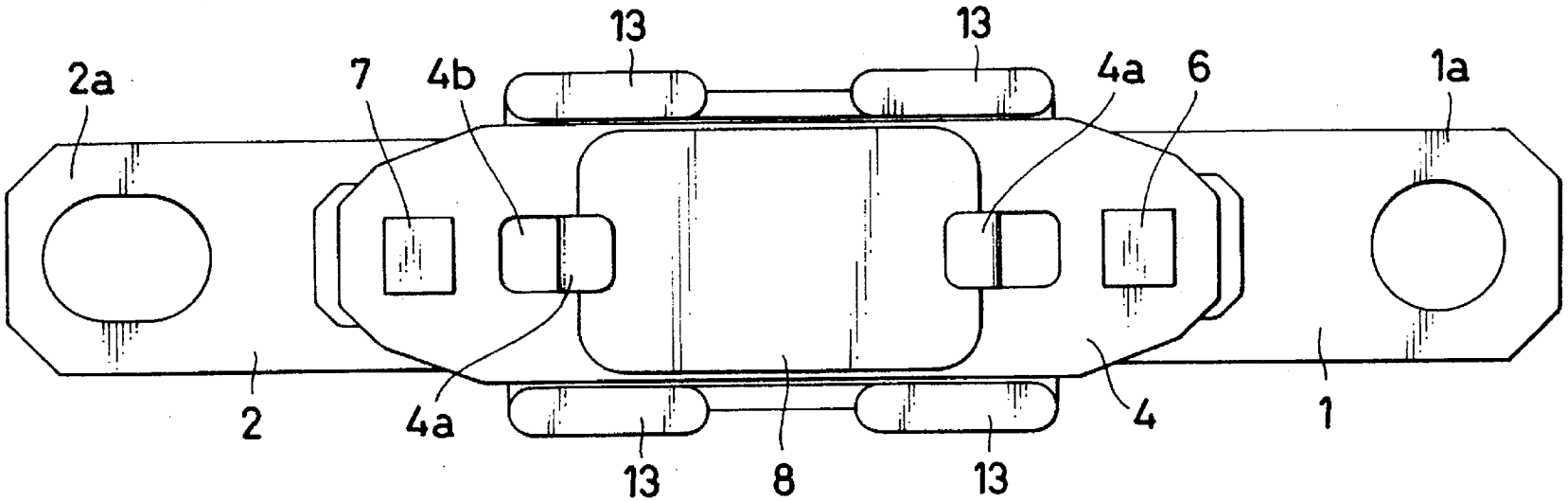
FIG. 2 is a top view of FIG. 1.

The embodiment of FIG. 1 includes the clamping means constituted by the clamp spring 9. The clamp spring 9 is sized so that the clamp spring penetrates the through hole when the second movable contact 7 is in contact with the second stationary contact 2*b* and the clamp spring does not penetrate the through hole when the movable contact 7 is separated from the stationary contact 2*b*. Consequently, when the movable contact 2*b* is separated from the second stationary contact, the tip of the clamp spring 9 is moved to abut against the lower surface of the resilient plate 4 as shown in FIG. 4.

At this time, even when the temperature is reduced again and the sign of the curvature of the shape of the bimetal plate 8 is changed, the resilient plate 4 is impeded by the clamp spring 9 and cannot be deformed. Accordingly, the circuit is maintained to be left open.

Figure 8:
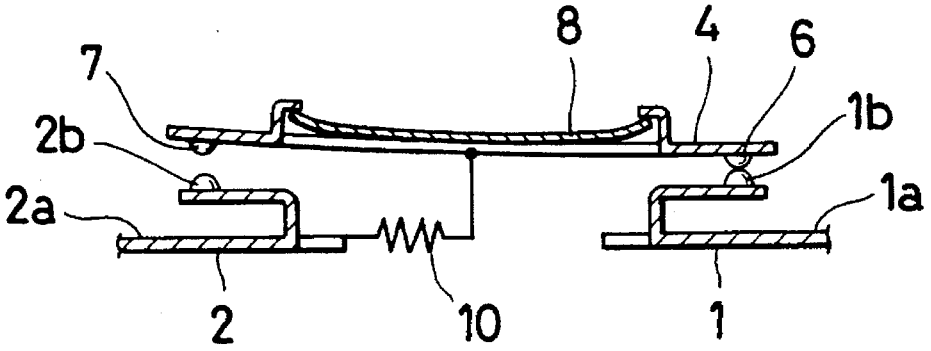
FIG. 8 is a sectional view showing another preferred embodiment of the present invention.

FIG. 8 schematically illustrates another preferred embodiment of the present invention. In this embodiment, the first stationary plate 1 and the second stationary plate 2 are connected to each other by means of a heat generating element constituted by an electrical resistor 10. As the electrical resistor 10, an element using conductive film surrounded by insulative film can be adopted.

When the first movable contact 6 and the second movable contact 7 are closed, almost no current flows through the electrical resistor 10, although when the second stationary contact 2*b* and the second movable contact 7 are separated from each other in the case where the first stationary contact 1*b*and the first movable contact 6 are welded, a current flows through the electrical resistor 10 to thereby generate heat from the electrical resistor.

Consequently, the temperature of the bimetal plate does not fall and the open state of the circuit is maintained. In other words, the electrical resistor 10 functions as the clamping means.

Figure 9:
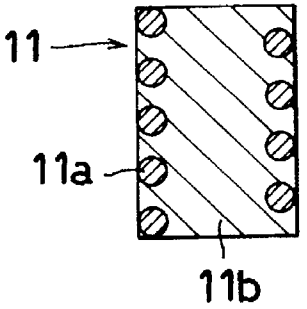
FIG. 9 is a sectional view of a fuse spring.
Figure 10:
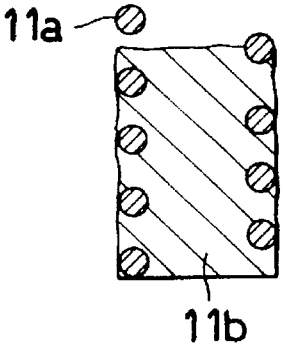
FIG. 10 is a sectional view of a fuse spring.
Figure 11:
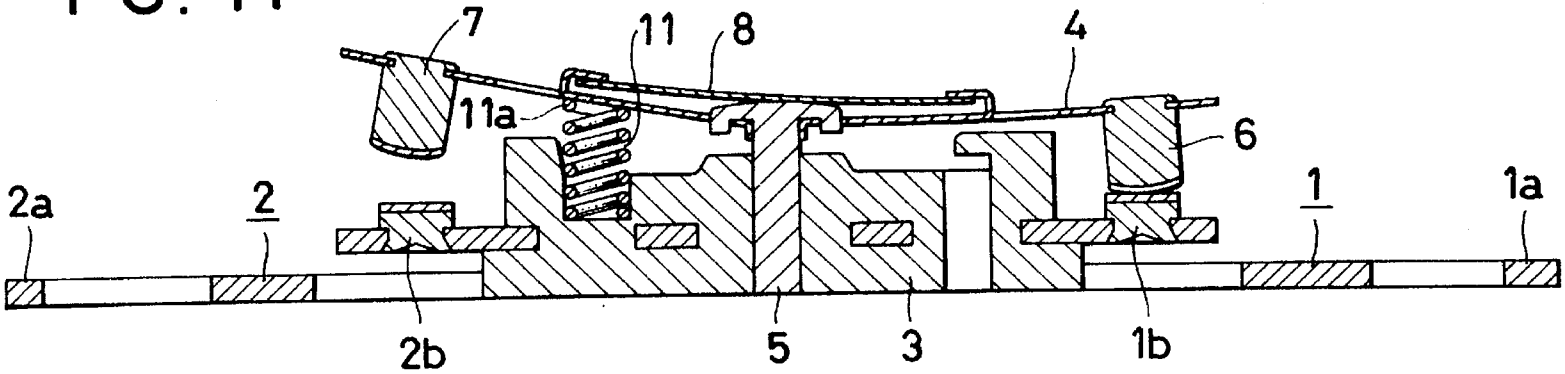
FIG. 11 is a sectional view showing still another preferred embodiment of the present invention.

FIGS. 9 to 11 show still another preferred embodiment of the present invention. Clamping means is constituted by a fuse spring 11 having a spring 11*a* embedded in easily meltable metal 11*b* such as fuse alloy or solder alloy when the spring 11*a* is compressed as shown in FIG. 9. The easily meltable metal is preferably a eutectic alloy made of at least two materials.

The easily meltable metal 11*b* is melted when the temperature exceeds the melting point of the easily meltable metal. Consequently, the spring 11*a* extends as shown in FIG. 10. Even when the temperature falls again, the spring 11*a* does not contract.

The embodiment of FIG. 11 is merely different from the embodiment of FIG. 1 in that the fuse spring 11 is used instead of the clamp spring 9. Thus, the same or common elements are designated by the same reference numerals and description thereof is omitted.

The fuse spring 11 of FIG. 9 is disposed on the side of the second stationary plate 2 on the side of the second movable contact 7 of the resilient plate 4. It is necessary to set the melting point of the easily meltable metal higher than the first set temperature $T_1$. When the first stationary contact 1*b* and the first movable contact are operated normally, the temperature of the fuse spring is designed to reach the melting point of the easily meltable metal.

When the temperature of the fuse spring 11 exceeds the melting point of the easily meltable metal in the case where the first stationary contact 1*b* and the first movable contact 6 are welded to each other, the easily meltable metal is melted and the spring 11*a* extends as shown in FIG. 10. Consequently, the second stationary contact 2*b* and the second movable contact 7 are separated from each other as shown in FIG. 11 and the circuit is opened. Even when the temperature is reduced again, the resilient plate 4 is pressed from the lower side by the spring 11*a* and accordingly the circuit is not closed.

Figure 12:
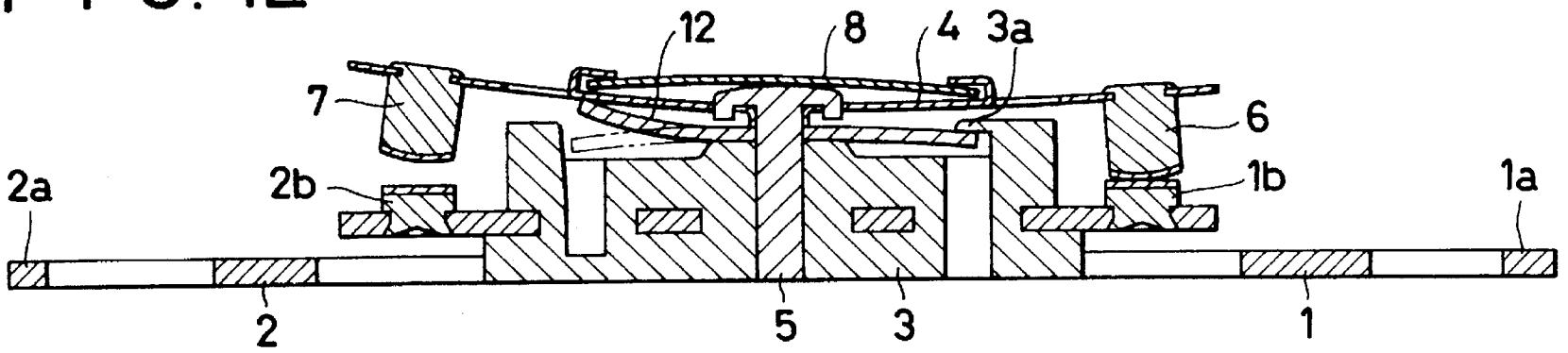
FIG. 12 is a sectional view of still another preferred embodiment of the present invention.

FIG. 12 shows still another preferred embodiment of the present invention. The same or common elements as those of FIG. 1 are designated by the same reference numerals and description thereof is omitted.

The embodiment employs a second thermally responsive element constituted by a second bimetal plate 12.

The second bimetal plate 12 is disposed on the side of the second stationary plate 2 of the resilient plate 4 as shown in FIG. 12 and the center support member 5 penetrates the second bimetal plate 12. The second bimetal plate 12 has a shape as shown by broken line at a lower temperature and includes one end which is engaged with a protrusion 3*a* of the board 3 and the other end which presses the resilient plate 4 from the lower side thereof as shown by solid line at a higher temperature.

The second bimetal plate 12 can be also used to define the second set temperature $T_2$ exactly. For this purpose, the second stationary contact 2*b* and the second movable contact 7, for example, are designed to begin to be separated from each other when both of the bimetal plate 8 and the second bimetal plate 12 change the signs of the curvature of their own shapes.

When the second bimetal plate 12 is used, the clamp spring 9, the electrical resistor 10 or the fuse spring 11 can be used in the same manner as the embodiment using only one bimetal plate 4.

The second bimetal plate 12 can be disposed on the side of the first stationary plate 1 of the first movable contact 6 of the resilient plate 4. The welded contacts can be usually separated from each other by a small shock, that is, a shock of the reversal of the second bimetal plate 12, so that the contacts are recovered.

Figure 13:
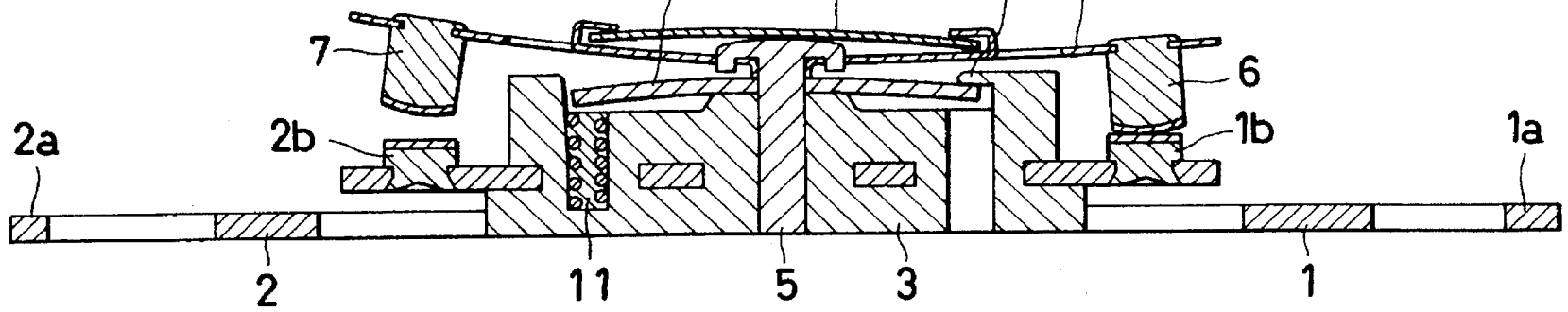
FIG. 13 is a sectional view of still another preferred embodiment of the present invention.

The embodiment of FIG. 13 uses a combination of the second bimetal plate 12 of FIG. 12 and the fuse spring 11 of FIG. 11. The same or common elements as those of FIGS. 1, 11 and 12 are designated by the same reference numerals and description thereof is omitted.

Material (for example, a beryllium and copper alloy, a titanium and copper alloy, a nickel silver alloy and stainless steel alloy) of the resilient plate is selected and is heated by an electric resistance. Thus, the bimetal plate 8 is brought into thermal contact with the resilient plate, so that the resilient plate can respond to a current flowing through the thermostat. At this time, it can be used as a current breaker. Further, the second thermally responsive element constituted by the bimetal plate 12 can be disposed not to come into contact with the resilient element, so that the second thermally responsive element can respond to temperature and the bimetal plate 8 can respond to current.

In the embodiments, the bimetal plate is used as the thermally responsive element, while it is not limited to the bimetal plate. One or both of the thermally responsive elements can be realized by a shape memory alloy, for example.

DESCRIPTION OF REFERENCE NUMERALS

1 first stationary plate
1*a* first terminal
1*b* first stationary contact
2 second stationary plate
2*a* second terminal
2*b* second stationary contact
3 board
4 resilient plate
4*a* claw
4*b* through hole
4*c* elongated hole
4*d* center hole
4*e* cut portion
4*f* cut portion
4*g* square hole
5 center support member
5*a* protrusion
6 first movable contact
7 second movable contact
8 bimetal plate
9 clamp spring
10 electrical resistor
11 fuse spring
11*a* spring
11*b* easily meltable metal
12 second bimetal plate
13 vertical guide member

I claim:

1. A double safety thermostat comprising a first stationary plate having a first terminal disposed in one end and connected to an external circuit and a first stationary contact disposed in the other end, a second stationary plate having a second terminal disposed in one end and connected to the external circuit and a second stationary contact disposed in the other end, a resilient plate having a first movable contact disposed in one end and a second movable contact disposed in the other end, a center support member for supporting said resilient plate at the center portion of said resilient plate, a thermally responsive member having a curvature of a shape thereof varying when a first predetermined set temperature is exceeded, and a plurality of claws for engaging said thermally responsive member with said resilient plate, said first stationary plate, and resilient plate and said second stationary plate being electrically disposed in series to one another, the strength of a spring on the side of said first movable contact of said resilient plate being weaker than the strength of a spring on the side of said second movable contact, said first stationary and movable contacts and said second stationary and movable contacts being in contact with each other, respectively, in a lower temperature than said first set temperature, said first movable contact being separated from said first stationary contact when said first set temperature is exceeded, said movable contact being separated from said second stationary contact when said first movable contact is welded to said first stationary contact and said first set temperature is exceeded, wherein the strength of the spring on the side of said first movable contact of said resilient plate is made weaker than the strength of the spring on the side of said second movable contact by substantially narrowing a width of said resilient member on the side of said first movable contact, and by providing ribs or rims in said resilient plate.

2. A double safety thermostat according to claim 1, comprising clamping means for maintaining the state of said second stationary contact and said second movable contact separated from each other when they are separated from each other.

3. A double safety thermostat according to claim 2, wherein said clamping means includes a spring which is sized so that said spring penetrates a through hole disposed in said resilient plate when said second stationary contact and said second movable contact are in contact with each other and comes off from said through hole when said second stationary contact and said second movable contact are separated from each other and which always presses said resilient plate in the longitudinal direction thereof and is disposed on the side of said second stationary plate of said second movable contact of said resilient plate.

4. A double safety thermostat according to claim 2, wherein said clamping means includes a heat generating element constituted by an electrical resistor for connecting said resilient plate and said second stationary plate, said heat generating element heating said thermally responsive member.

5. A double safety thermostat according to claim 2, wherein said clamping means includes a fuse spring which is embedded in an easily meltable alloy in a contracted state thereof and which is disposed on the side of said second stationary plate of said second movable contact of said resilient plate.

6. A double safety thermostat according to claim 1, wherein when said first stationary contact and said first movable contact are welded to each other, said second stationary contact and said second movable contact function as a reversible thermostat.

7. A double safety thermostat according to claim 1, wherein a second thermally responsive member having a sign of the curvature of a shape thereof being reversed at a second set temperature higher than a first set temperature at which a sign of the curvature of a shape of said thermally responsive member is reversed is disposed in the vicinity of said first or second stationary plate of said resilient plate so that said first or second movable contact is separated from said first or second stationary contact, respectively.

8. A double safety thermostat according to claim 7, wherein said second stationary contact and said second movable contact begin to be separated from each other when the sign of the curvature of the shape of said second thermally responsive member is reversed.

9. A double safety thermostat according to claim 1, wherein said resilient plate is self-heated by an electric resistance and said thermally responsive member comes into thermal contact with said resilient plate, said thermally responsive member responding to a current flowing through said thermostat.

10. A double safety thermostat according to claim 7, wherein said resilient plate is self-heated by an electric resistance and said thermally responsive member comes into thermal contact with said resilient plate, said thermally responsive member responding to a current flowing through said thermostat, said second thermally responsive member being disposed not to come into contact with said resilient plate directly, said second thermally responsive member responding to a temperature.

11. A double safety thermostat according to claim 7, comprising clamping means for maintaining the state of said second stationary contact and said second movable contact separated from each other when they are separated from each other.

12. A double safety thermostat according to claim 11, wherein said clamping means is said clamping means of claim 3 or 4 or 5.

13. A double safety thermostat according to claim 1, wherein said thermally responsive member comprises a bimetal plate.

14. A double safety thermostat according to claim 1, wherein said thermally responsive member is formed of a shape memory alloy.

15. A double safety thermostat according to claim 7, wherein said second thermally responsive member comprises a bimetal plate.

16. A double safety thermostat according to claim 7, wherein said second thermostat responsive member is formed of a shape memory alloy.

17. A double safety thermostat according to claim 5, wherein said easily meltable alloy is a eutectic alloy made of at least two materials.

* * * * *